US006945724B2

(12) United States Patent
Suzuki et al.

(10) Patent No.: US 6,945,724 B2
(45) Date of Patent: Sep. 20, 2005

(54) COATING TOOL AND STORAGE CONTAINER

(75) Inventors: Yoshiaki Suzuki, Kanagawa (JP); Masanori Takenouchi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/737,778

(22) Filed: Dec. 18, 2003

(65) Prior Publication Data

US 2004/0126176 A1 Jul. 1, 2004

Related U.S. Application Data

(62) Division of application No. 10/230,121, filed on Aug. 29, 2002, now Pat. No. 6,666,606.

(30) Foreign Application Priority Data

Sep. 4, 2001 (JP) ..... 2001-267316

(51) Int. Cl.[7] ..... A46D 33/00
(52) U.S. Cl. ..... 401/130; 401/126
(58) Field of Search ..... 401/118, 124, 401/126–130

(56) References Cited

U.S. PATENT DOCUMENTS

| | | | | | |
|---|---|---|---|---|---|
| 342,206 | A | | 5/1886 | Hudswell | 401/127 |
| 558,245 | A | | 4/1896 | Williams | 401/127 |
| 835,955 | A | | 11/1906 | Kuter | 401/127 |
| 1,562,867 | A | * | 11/1925 | Bush | 401/127 |
| 1,715,144 | A | | 5/1929 | Paulson | 401/121 |
| 1,921,248 | A | | 8/1933 | Carpenter | 401/130 |
| 1,980,878 | A | | 11/1934 | Robinson | 401/126 |
| 2,050,676 | A | | 8/1936 | Thomas | 401/119 |
| 2,461,893 | A | * | 2/1949 | Pasquale | 220/301 |
| 2,517,663 | A | * | 8/1950 | Hendry et al. | 401/127 |
| 2,689,966 | A | | 9/1954 | Reuss | 401/125 |
| 2,917,766 | A | | 12/1959 | Ciffo | 206/15.2 |
| 3,185,291 | A | | 5/1965 | Lerner | 206/209 |
| 3,480,371 | A | | 11/1969 | Lee | 401/121 |
| 5,071,277 | A | | 12/1991 | Braun | 401/126 |
| 5,829,902 | A | | 11/1998 | Fomby | 401/127 |
| 6,666,606 | B2 | * | 12/2003 | Suzuki et al. | 401/127 |
| 2003/0070614 | A1 | | 4/2003 | Suzuki | 118/264 |

* cited by examiner

*Primary Examiner*—Justine R. Yu
*Assistant Examiner*—Huyen Le
(74) *Attorney, Agent, or Firm*—Fitzpatrick, Cella, Harper & Scinto

(57) ABSTRACT

A storage container of a coating tool can effectively prevent a coating liquid from sticking to a handle member of the coating tool. The storage container for storing the coating tool comprises a holding container for containing the coating tool and a closure member for closing the holding container with the coating tool contained in the holding container. The coating tool is provided with a handle to be used by the user to hold the coating tool, and the closure member is provided with an opening that allows the handle to pass through. When the holding container is closed by means of the closure member with the coating tool stored in the holding container, the handle of the coating tool projects outward through the opening.

12 Claims, 8 Drawing Sheets

COATING TOOL AND STORAGE CONTAINER

This application is a division of application Ser. No. 10/230,121, filed Aug. 29, 2002, now U.S. Pat. No. 6,666, 606 issued Dec. 23, 2003, the contents of which are incorporated herein by reference.

BACKGROUND OF THE INVENTION

1. Field of the Invention

This invention relates to a storage container for containing a coating tool to be used for applying relatively highly viscous liquid. More particularly, the present invention relates to a storage container for containing liquid to be used for protecting images of recorded products obtained typically by means of an ink-jet recording method.

2. Related Background Art

Coating tools for applying relatively highly viscous liquid such as car waxes, water-repellent glass coating agents, paints, cosmetics and cooking oils are known. Coating tools normally-comprise an absorbing member for absorbing liquid to be applied and a support member supporting the absorbing member. The support member is provided with a handle.

For applying a coating liquid by means of such a coating tool, firstly the absorbing member of the coating tool is made to absorb the coating liquid, which is then applied to an object to be coated. When the absorbed the coating liquid is running out, again the absorbing member is made to absorb the coating liquid and the absorbed coating liquid is applied to the object. The object will be entirely coated with the coating liquid by repeating this cycle of operation.

As pointed out above, it is necessary that the coating liquid is absorbed by the absorbing member before starting the use of the coating tool. Therefore, to quickly start a coating operation, the absorbing member is desirably in such a state that the coating liquid is already absorbed by it when the coating tool is held in storage. Thus, it may be a good idea that the coating tool is stored in such a state that the absorbing member is dipped in the coating liquid contained in a storage container.

However, if the coating tool is stored in such a state that the absorbing member is dipped in the coating liquid contained in a storage container, some of the coating liquid contained in the storage container may adhere to the support member of the coating tool to smear the handle of the coating tool. When the handle of the coating tool is smeared, the user not only feels unpleasant when he or she uses it but also is forced to clear the handle by wiping it clean so as to prevent the coating liquid that has already been moved from the handle to the hand from sticking to some other object. Then, the efficiency of the coating operation will inevitably be decreased. Particularly, if the coating liquid is nonvolatile, it will persistently stick to the hand to remarkably reduce the efficiency of the coating operation.

SUMMARY OF THE INVENTION

In view of the above identified circumstances, it is therefore the object of the present invention to provide a storage container for containing a coating tool that can prevent a coating liquid from sticking to the handle of the coating tool.

According to the invention, the above object is achieved by providing a storage container comprising a holding container adapted to hold a coating tool for applying a liquid and a closure member adapted to close said holding container holding said coating tool, said coating tool being provided with a handle section to be used for gripping said coating tool, said closure member being provided with an opening through which said handle section passes, said storage container having such a structure that said handle section projects outward through said opening when closing said holding container by means of said closure member with said coating tool held in said holding container.

With a storage container having the structure as described above, the handle section of the coating tool projects outward from the storage container during storage of the coating tool so that the coating liquid contained in the storage container does not stick to the handle section of the coating tool during storage and hence the efficiency of coating operation is prevented from decreasing. Additionally, if the user tries to place the storage container upside down by mistake with the closure member disposed at the bottom, the handle section calls for attention on the part of the user, requesting the user to place the storage container properly because it is unstable and easily topples down if it is held upside down.

Preferably, said coating tool is provided with a rib adapted to abut the inner edge of said closure member along the entire boundary of said opening when said holding container is closed by means of said closure member with the coating tool held in said holding container, and said holding container is provided with a rib adapted to abut the entire outer edge and/or the vicinity thereof of said closure member when said holding container is closed by means of said closure member. With this arrangement, the gap separating the holding container and the closure member and the gap separating the handle section of the coating tool and the edge of the closure member defining the opening are tightly closed when the holding container containing the coating tool is closed by means of the closure member so that no coating liquid would leak out from the container through the gaps.

Preferably, the rigidly of said closure member is less than that of the rib of said coating tool and that of the rib of said holding container. With this arrangement, the ribs abutting the closure member are elastically deformed and held tightly in contact with the closure member when the closure member is fitted firmly to the holding container containing the coating tool to close the latter. Then, the gap separating the holding container and the closure member and the gap separating the handle section of the coating tool and the edge of the closure member defining the opening are reliably and tightly closed Alternatively, it may be so arranged that said closure member is provided with a seal member adapted to abut both the rib of said coating tool and that of said holding container when it is fitted to the holding container to close the latter. With this arrangement, again, the gap separating the holding container and the closure member and the gap separating the handle section of the coating tool and the opening of the closure member are reliably and tightly closed.

Preferably, said closure member is provided along its inner edge defining said opening with a reinforcement rib. With this arrangement, the strength of the closure member is intensified in the vicinity of the opening.

Preferably, said handle member of said coating tool is provided along the lateral surfaces thereof with a sealing member surrounding said handle member to seal the closure member at the opening, and said closure member is provided along the opening thereof with a rib adapted to abut said opening seal member along the entire periphery thereof when said holding container containing said coating tool is closed by said closure member.

Preferably, said handle member is made to have a substantially cylindrical profile at the part provided with said opening seal member, and the part located closer to the front end relative to said part provided with said opening seal member is provided with two substantially parallel planar areas. With this arrangement, the sealing effect of the opening seal member and the rib of the closure member surrounding the opening can be enhanced at the part having a substantially cylindrical profile, and the part having two substantially parallel planar areas provides such an advantage that user can easily grasp the handle section at those areas.

Preferably, the inner surface of said holding container is provided with a stepped section, and said coating tool is provided with an abutting section adapted to abut said stepped section when said coating tool is contained in said holding container.

Preferably, said coating tool is provided with a rib for supporting said abutting section. With this arrangement, when the closure member is fitted to the holding container containing the coating tool, the coating tool is prevented from being deformed to warp if it is pushed by the closure member.

Preferably, said coating tool is provided at the bottom thereof with an absorbing member adapted to hold the liquid, and the height of said stepped section from the bottom of said holding container is such that said absorbing member comes into contact with the bottom of said holding container without being deformed when said abutting section of said coating tool abuts on said stepped section of said holding container. With this arrangement, the absorbing member of the coating tool during storage can absorb the coating liquid in the holding container and the user can immediately start using the coating tool by removing the closure member.

Alternatively, it may be so arranged that said coating tool is provided at the bottom thereof with an absorbing member adapted to hold the liquid, and the height of said stepped section from the bottom of said holding container is such that said absorbing member being elastically deformed comes into contact with the bottom of said holding container when said abutting section of said coating tool abuts on said stepped section of said holding container. With this arrangement, the absorbing member elastically deformed during storage restores its original profile by its own restoring capability when the closure member is removed so that it efficiently absorbs the coating liquid in the inside of the holding container. Preferably, said abutting section is arranged over the entire outer periphery of said coating tool, said stepped section is arranged over the entire inner lateral surface of said holding container, and an abutting section sealing member for tightly closing the gap between said stepped section and said abutting section along the entire peripheries thereof is provided on said stepped section. With this arrangement, no coating liquid adheres to the outer lateral surface of the coating tool above the abutting section thereof during storage so that the risk of smearing the user's hand with the coating liquid can be minimized when he or she use the coating tool. The net result will be a minimal reduction in the efficiency of coating operation.

Furthermore, it may be so arranged that said coating tool can rotate around said handle section when it is contained in said holding container. With this arrangement, if the amount of the coating liquid remaining in the holding container is very small, the coating liquid contained in the holding container can completely be exploited by rotating the coating tool so as to scratch the bottom surface of the holding container and absorb the coating liquid.

Preferably, the area of the bottom of said holding container is greater than the area of said coating tool stored in said holding container as projected on the bottom of said holding container if viewed from the right top. With this arrangement, the coating liquid can be supplied into the holding container by dropping it toward the bottom area of the holding container not covered by the coating tool if the latter is contained in the holding container, and the ongoing coating liquid supplying operation and the amount of the supplied coating liquid can be visually observed.

Preferably, at least said holding container is made of a transparent material so that the amount of coating liquid remaining in the holding container can be visually observed from the outside.

Furthermore, preferably, a liquid level line is arranged at a predetermined height from the bottom of said holding container on the inner surface of the latter so that the coating liquid may be supplied into the holding container by an optimal amount. Then, the amount of the coating liquid applied to the object to be coated by the coating tool can be controlled by controlling the amount of the coating liquid supplied into the holding container.

Alternatively, it may be so arranged that said coating tool is so designed as to contain the liquid in the inside of said handle section. With this arrangement, it is no longer necessary to pour the coating liquid into the holding container to be absorbed by the coating tool so that the efficiency of applying coating liquid can be further improved.

DETAILED DESCRIPTION OF THE INVENTION

Now, the present invention will be described in greater detail by referring to the accompanying drawings that illustrate preferred embodiments of the invention.

First Embodiment

Figure 1A:
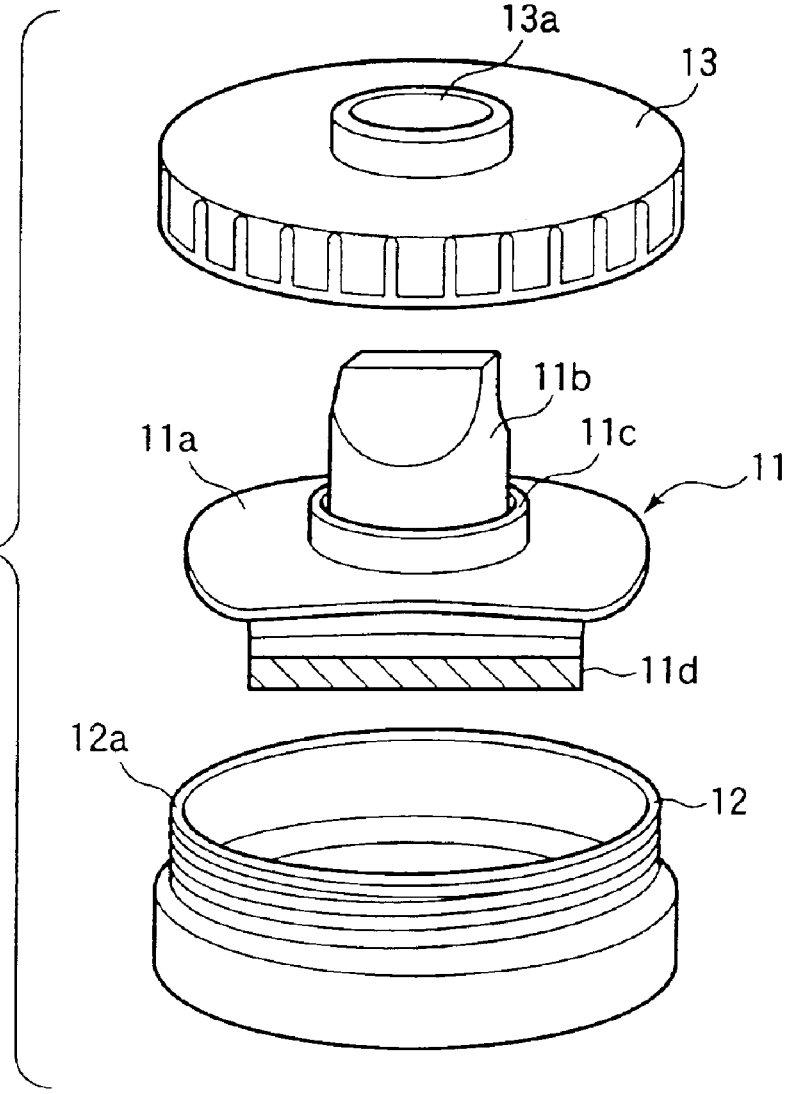
FIGS. 1A and 1B are schematic perspective views of the first embodiment of the storage container according to the invention.
Figure 1B:
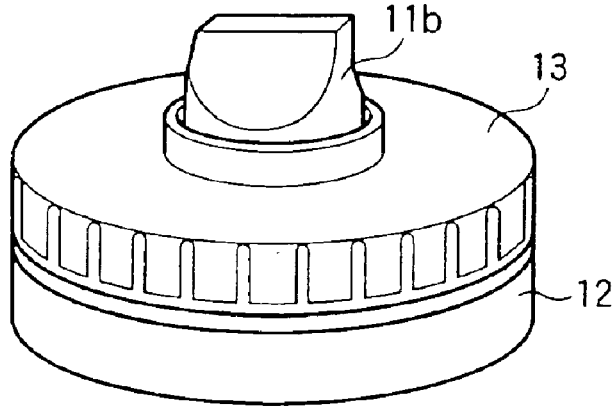
Figure 2A:
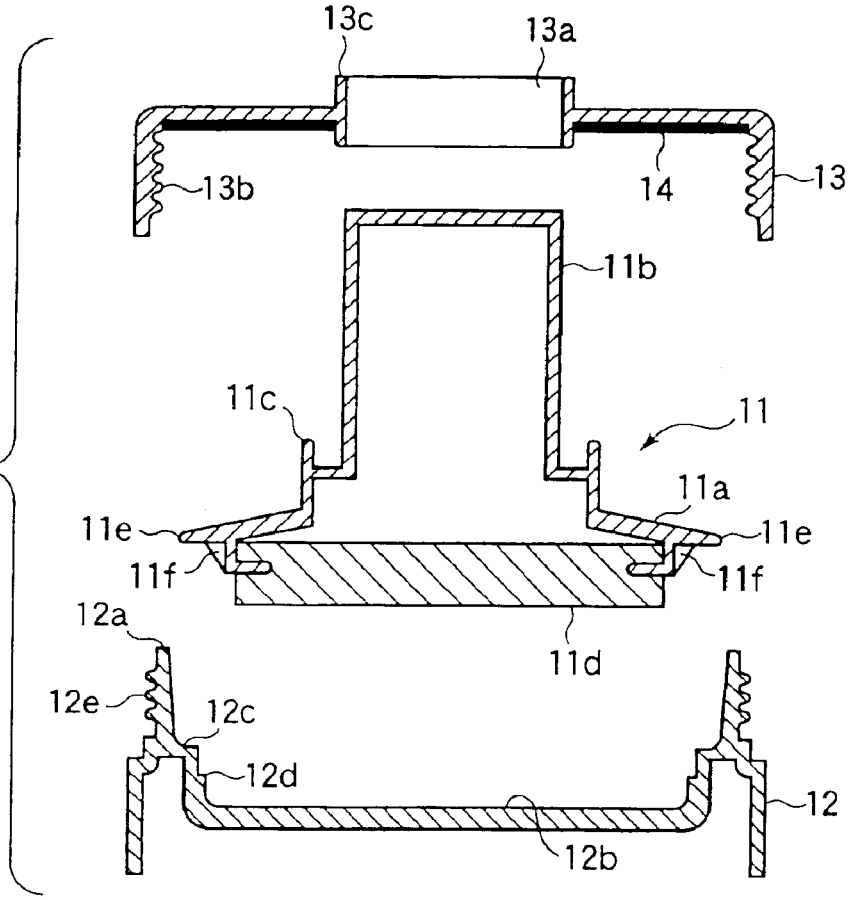
FIGS. 2A and 2B are schematic cross sectional views of the first embodiment of the storage container.
Figure 2B:
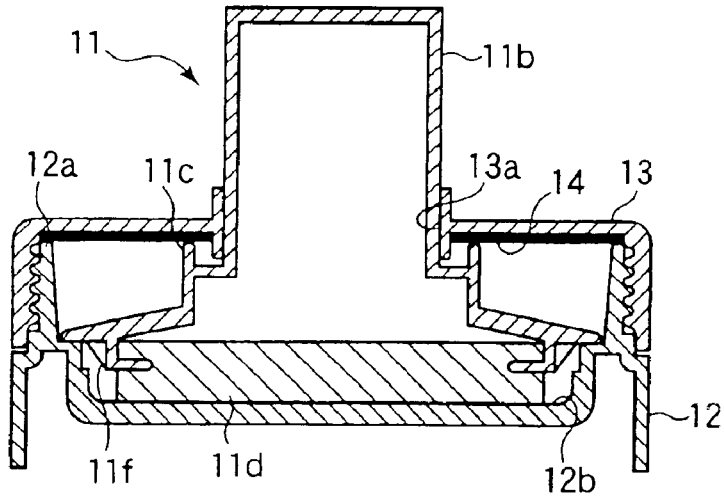

FIGS. 1A and 1B are schematic perspective views of the first embodiment of the storage container according to the invention and FIGS. 2A and 2B are schematic cross sectional views of the first embodiment of the storage container shown in FIGS. 1A and 1B. Of FIGS. 1A, 1B, 2A and 2B, FIGS. 1A and 2A are exploded views of the container, showing the components thereof, whereas FIGS. 1B and 2B are views of the assembled container.

Firstly, the configuration-of the coating tool 11 that is adapted to be stored in the storage container of this embodiment will be described.

The coating tool 11 comprises a support member 11*a*, a handle 11*b* extending vertically upward from a central area of the support member 11*a* and an absorbing member 11*d* supported by the support member 11*a* at the side opposite to the handle 11*b*. A rib 11*c* is arranged on the support member 11*a* so as to surround the handle 11*b*. Since the handle 11*b* is vitally important for the coating operation using the coating tool 11, its profile is determined by considering "the feeling of gripping" and "the feeling of fitness" that are greatly influenced by the shape, the width and the thickness of the handle.

As will be described in greater detail hereinafter, an absorbing member 11*d* is adapted to absorb a coating liquid to apply the coating liquid to the surface to be coated with the coating liquid. It has a substantially rectangularly parallelepipedic profile, and the support member 11*a* supporting the absorbing member 11*d* has a rectangular bottom surface that is substantially as large as the top surface of the absorbing member 11*d*. As a result of using a substantially rectangularly parallelepipedic absorbing member 11*d* and supporting it under the support member 11*a* having the substantially same bottom surface as the top surface of the absorbing member 11*d*, the area being coated by means of the coating tool 11 can be visually observed with ease and hence the risk of producing uncoated areas is minimized.

The absorbing member 11*d* is supported by the support member 11*a* as the grooves formed on the opposite lateral sides of the absorbing member 11*d* are held in engagement with the pawl sections arranged on the support member 11*a*. Although the absorbing member 11*d* may be bonded to the support member 11*a* by means of an adhesive, some of the ingredients of the adhesive agent can be eluted into the coating liquid absorbed by the absorbing member 11*d* to cause the coating liquid to change in quality. Therefore, it is preferable to use a support structure of grooves and pawls as described above without resorting to an adhesive agent.

Materials that can be used for the absorbing member 11*d* include a sponge typically made of polyurethane, felt, cloth, paper and other porous and/or fibrous materials. The surfaces to be coated with the coating liquid may not always be uniform planes but may have undulations to some extent. Therefore, it is preferable that the absorbing member 11*d* is made of a material that can be deformed to accommodate the undulations of the surface being coated. From this point of view, the use of a sponge made of polyurethane is particularly advantageous. For the purpose of uniformly applying the coating liquid absorbed by the absorbing member 11*d* to the object of coating, the absorbing member 11*d* preferably shows only small load dependency. In other words, it is preferable that the coating amount is not changed significantly by the load applied to the absorbing member 11*d*. Since the load dependency of the absorbing member 11*d* is mostly defined by its density, it is preferable that the density of the absorbing member 11*d* is appropriately selected so as not to cause large load dependency.

Now, the holding container 12 and the closure member 13 of this embodiment of the storage container will be described below.

The inside of the holding container 12 serves as holding section 12*b* for containing the support member 11*a* and the absorbing member 11*d* of the coating tool 11 and the coating liquid to be absorbed by the absorbing member 11*d*. The holding container 12 is provided on the inner surface thereof with a stepped section 12*c* on which stopper 11*e*, or abutting section, arranged along the outer edge of the support member 11*a* abuts and a liquid level line 12*d* defining the amount of the coating liquid to be poured into the holding container 12. The liquid level line 12*d* is formed on the inner surface of the holding container 12 by a step, a groove, a projection or a marking that is very small and arranged at a predetermined height from the bottom surface of the holding section 12*b*. In this embodiment, the liquid level line 12*d* is arranged at such a height that, when coating liquid is poured into the holding container 12 to the liquid level line 12*d*, the amount of the poured liquid is substantially equal to the amount that can be absorbed by the absorbing member 11*d*. The holding container 12 is provided on the outer surface thereof with a thread 12*e* that comes into engagement with the corresponding thread 13*b* of the closure member 13 when the latter is fitted to the holding container 12.

The holding container 12 is provided at the upper end thereof with a rib 12*a* that abuts on the inner surface of the closure member 13 when the container 12 is closed by the latter. The rib 12*a* is arranged in such a way that, when the coating tool 12 is contained in the holding container 12 and the stopper 11*e* of the support member 11*a* abuts on the stepped section 12*c* of the holding section 12*b*, it is substantially flush with the rib 11*c* of the support member 11*a*.

On the other hand, the closure member 13 is provided at the center thereof with an opening 13*a* having a diameter that allows the handle 13*b* of the coating tool 11 to pass through. A reinforcement rib 13*c* is arranged along the peripheral edge of the closure member 13 defining the opening 13*a* in order to improve the strength of the peripheral edge. The inner surface of the lateral wall of the closure member 13 is provided with a thread 13*b* that comes into engagement with the corresponding thread 12*e* of the holding container 12. A packing sheet 14 is fitted to the inner surface of the closure member 13. The packing sheet 14 is made of an elastic material such as rubber and serves as a seal member for ribs.

Of the above described components, at least the holding container 12 is preferably made of a transparent material. When the holding container 12 is made of a transparent material, the coating liquid remaining in the holding container 12 and the condition of the coating liquid absorbed by the absorbing member 11*d* can be visually observed from the outside of the holding container 12.

Now, the operation of this embodiment of the storage container will be described below.

In the initial condition, the absorbing member 11*d* of the coating tool 11 is not impregnated with any coating liquid and no coating liquid is poured into the holding container 12. In other words, before starting using the coating tool 11, the absorbing member 11*d* has to be impregnated with a coating liquid. Thus, the coating liquid is poured into the holding container 12 until it gets to the liquid level line 12*d* and the absorbing member 11*d* is dipped into the coating liquid so that it may absorb substantially all the coating liquid poured into the holding container 12.

Subsequently, as the coating liquid is applied to the object of coating by means of the coating tool 11 so that the amount of the coating liquid held by the absorbing member 11*d* is reduced, and then the coating liquid is poured into the holding container 12 by an appropriate amount to cause the absorbing member 11*d* to absorb it. Since the amount of the coating liquid initially poured into the holding container 12 up to the liquid level line 12*d* is the maximum amount that the absorbing member 11*d* can absorb, the amount of the coating liquid that is absorbed by the absorbing member 11*d* out of the amount of the coating liquid poured into the holding container 12 is equal to the amount of the coating liquid applied to the object of coating by the coating tool 11. In this way, the amount of the coating liquid applied to the object of coating by the coating tool 11 can be controlled by initially causing the absorbing member 11*d* to maximally absorb the coating liquid. Thus, it is possible to avoid a situation where the coating liquid is applied excessively or too scarcely.

FIGS. 1B and 2B illustrate the storage container containing the coating tool 11.

As shown in FIGS. 1B and 2B, when the coating tool 11 is contained in the holding container 12 and the closure member 13 is screw-fitted to the holding container 12 so that the coating tool 11 is stored in the storage container, the handle 11*b* of the coating tool 11 projects to the outside of the storage container through the opening 13*a* of the closure member 13. Therefore, no coating liquid in the storage container will adhere to the handle 11*b* when the coating tool 11 is in storage so that the efficiency of coating operation is prevented from decreasing. Additionally, if the user tries to place the storage container upside down by mistake with the closure member 13 disposed at the bottom, the handle 11*b* calls for attention to the user, requesting the user to place the storage container properly because it is unstable and easily topples down if it is held upside down.

Furthermore, when the coating tool 11 is contained in the holding container 12, the rib 11*c* of the coating tool 11 and the rib 12*a* of the holding container 12 are substantially flush with each other. When the closure member 13 is fitted to the holding container 12 in this condition, the two ribs 11*c*, 12*a* abuts on the packing sheet 14 on the inner surface of the closure 13 as shown in FIG. 2B. Therefore, no coating liquid will leak out from the inside of the storage container through the gap between the holding container 12 and the closure member 13 and/or through the opening 13*a* of the closure member 13.

While the closure member 13 is provided on the inner surface thereof with a packing sheet 14 in the above description, the closure member 13 does not necessarily have to be provided on the inner surface thereof with a packing sheet 14. However, if the closure member 13 is not provided on the inner surface thereof with a packing sheet 14, it is necessary that the two ribs 11*c*, 12*a* directly abut on the inner surface of the closure member 13 when the holding container 12 is closed by the closure member 13 with the coating tool 11 contained in the holding container 12. If such is the case, the rigidity of the two ribs 11*c*, 12*a* is preferably higher than that of the closure member 13. Then, the closure member 13 is elastically deformed when it is fitted firmly to the holding container 12 so that the ribs 11*c*, 12*a* abutting on the closure member are held tightly in contact with the closure member to prevent liquid from leaking outside.

The support member 11*a* is provided on the inner surface thereof with a rib 11*f* located close to the stopper 11*e*. The rib 11*f* operates to suppress the warp of the support member 11*a* that can be caused by the rib 11*c* pressed down by the closure member 13 when the closure member 13 is firmly fitted to the holding container 12.

The stepped section 12*c* on the inner surface of the holding container 12 is arranged at such a height from the bottom surface of the holding container 12 that, when the stopper 11*e* of the coating tool 11 is brought to abut on the stepped section 12*c*, the lower surface of the absorbing member 11*d* exactly touches the bottom surface of the holding container 12. With this arrangement, when the coating tool 11 is stored in the storage container, the absorbing member 11*d* of the coating tool 11 satisfactorily absorbs a coating liquid in the holding container 12 and hence the operation of using the coating tool can be started quickly.

For the absorbing member 11*d* to reliably absorb the coating liquid, the height of the stepped section 12*c* from the bottom surface of the holding container 12 may alternatively be made smaller than the above defined height so that, when the stopper 11*e* of the coating tool 11 is brought to abut on the stepped section 12*c*, the absorbing member 11*d* is deformed within its elastic deformation limit and touches the bottom surface of the holding container 12. With this alternative arrangement, when the closure member 13 is removed from the holding container 12 storing the coating tool 11, the absorbing member 11*d* that has been deformed restores its original size by its own restoring force. When the absorbing member 11*d* restores its original profile, it absorbs the coating liquid remaining on the bottom of the holding container 12. Thus, the absorbing member 11*d* can absorb the coating liquid more reliably and efficiently.

Figure 3:
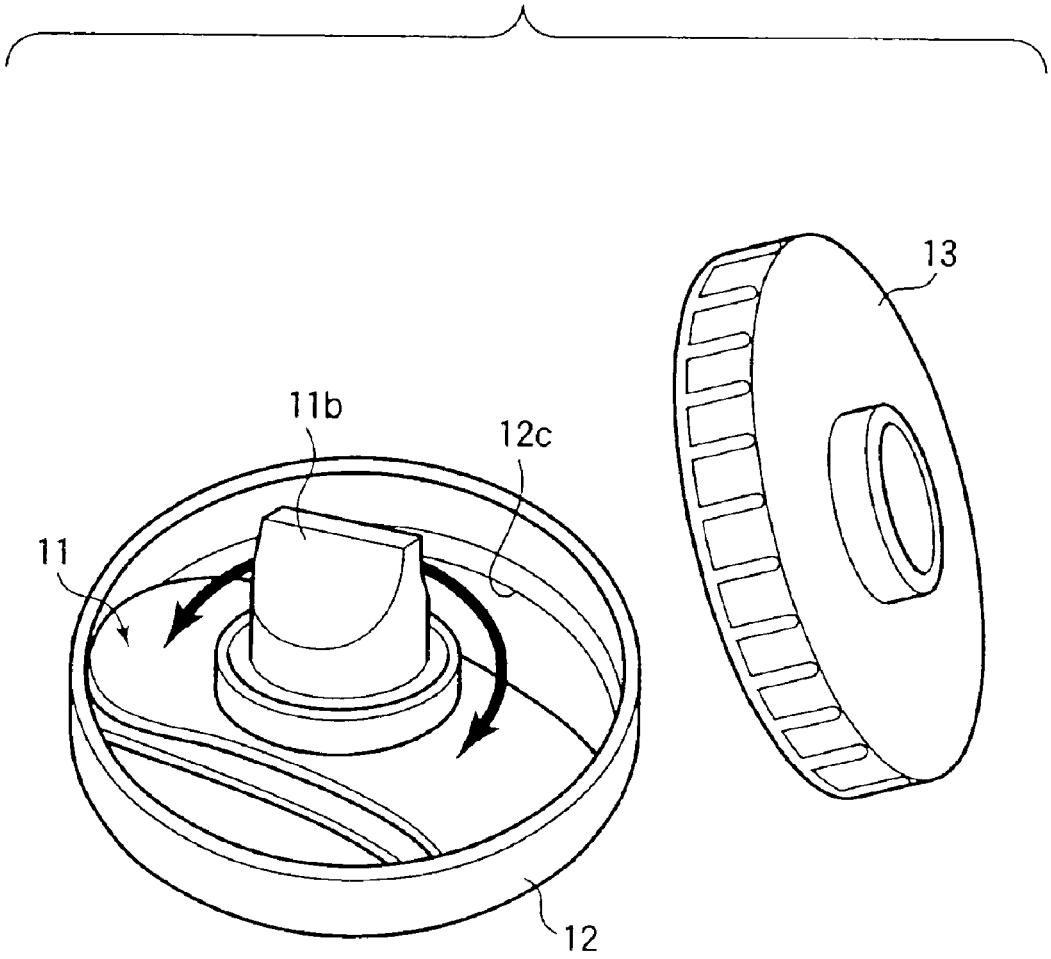
FIG. 3 is a schematic perspective view of the first embodiment, illustrating the holding container thereof containing the coating tool.

FIG. 3 is a schematic perspective view of the first embodiment, illustrating the holding container thereof containing the coating tool.

The stepped section 12*c* arranged on the inner surface of the holding container 12 extends along all the lateral side of the holding container 12. Therefore, when the stopper 11*e* of the coating tool 11 is brought to abut on the stepped section 12*c*, that is, when and hence the absorbing member 11*d* (see FIGS. 1A and 1B) touches the bottom surface of the holding container 12, the coating tool 11 can be rotated around the handle 11*b* in either of the two opposite directions. Thus, if the amount of coating liquid remaining in the holding container 12 is very small, the coating liquid contained in the holding container 12 can completely be exploited by rotating the coating tool 11 so as to make the absorbing member 11*d* scratch the bottom surface of the holding container 12 and absorb the coating liquid.

Figure 4:
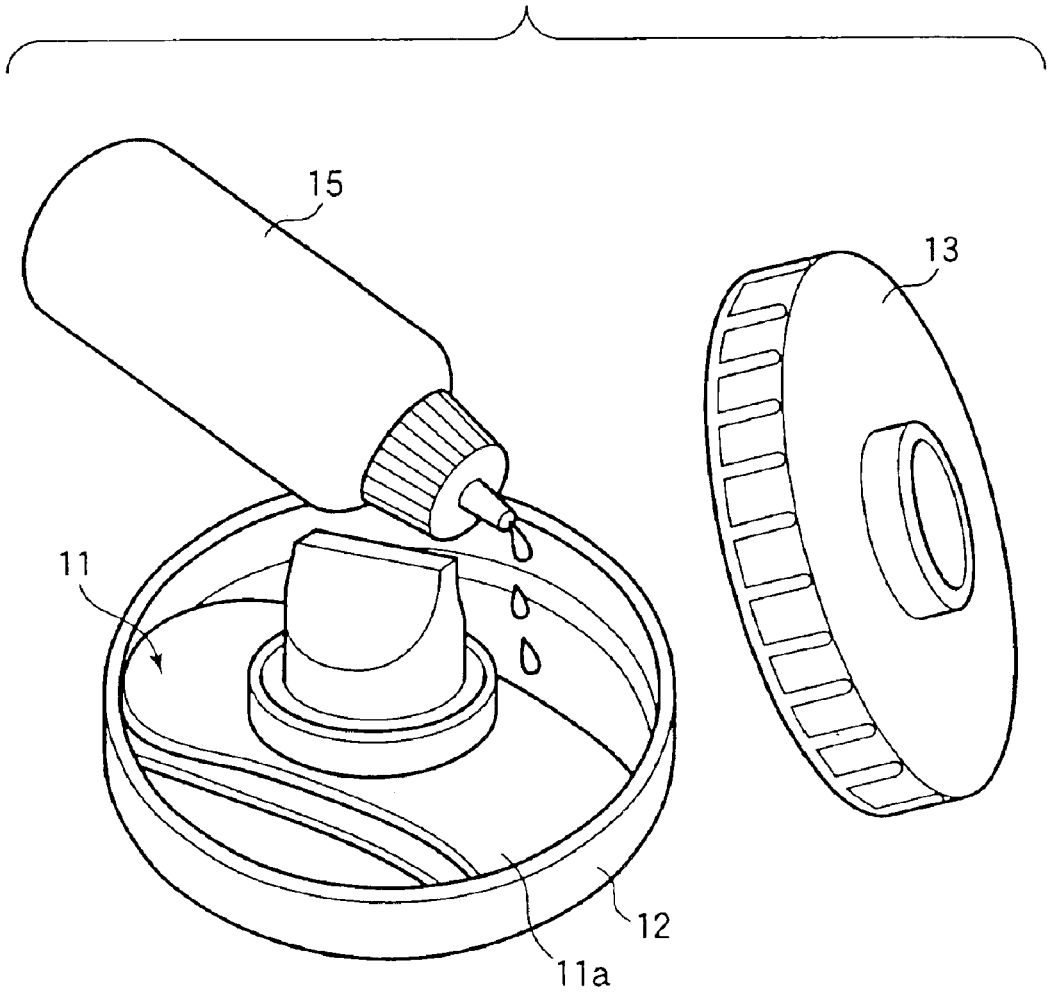
FIG. 4 is a schematic perspective view of the first embodiment, illustrating supply of the coating liquid into the holding container thereof.

FIG. 4 is a schematic perspective view of the first embodiment, illustrating supply of the coating liquid into the holding container.

As pointed out above, the absorbing member 11*d* (see FIGS. 1A and 1B) has a substantially rectangularly parallelepipedic profile, and the support member 11*a* supporting the absorbing member 11*d* has a rectangular bottom surface that is substantially as large as the top surface of the absorbing hereby 11*d*. On the other hand, the holding container 12 containing the coating tool 11 has a cylindrical profile with a diameter slightly greater than the largest length of the support member 11*a*. Therefore, the area of the bottom of the holding container 12 is greater than the area of the coating tool 11 stored in said holding container 12 as projected on the bottom of the holding container 12 if viewed from the right top.

With this arrangement, the coating liquid can be supplied into the holding container 12 without causing it to adhere to the support member 11*a* by dropping it from bottle 15 toward the bottom area of the holding container 12 not covered by the coating tool 11 if the latter is contained in the holding container 12 as shown in FIG. 4, and the ongoing coating liquid supplying operation and the amount of the supplied coating liquid can be visually observed.

Second Embodiment

Figure 5A:
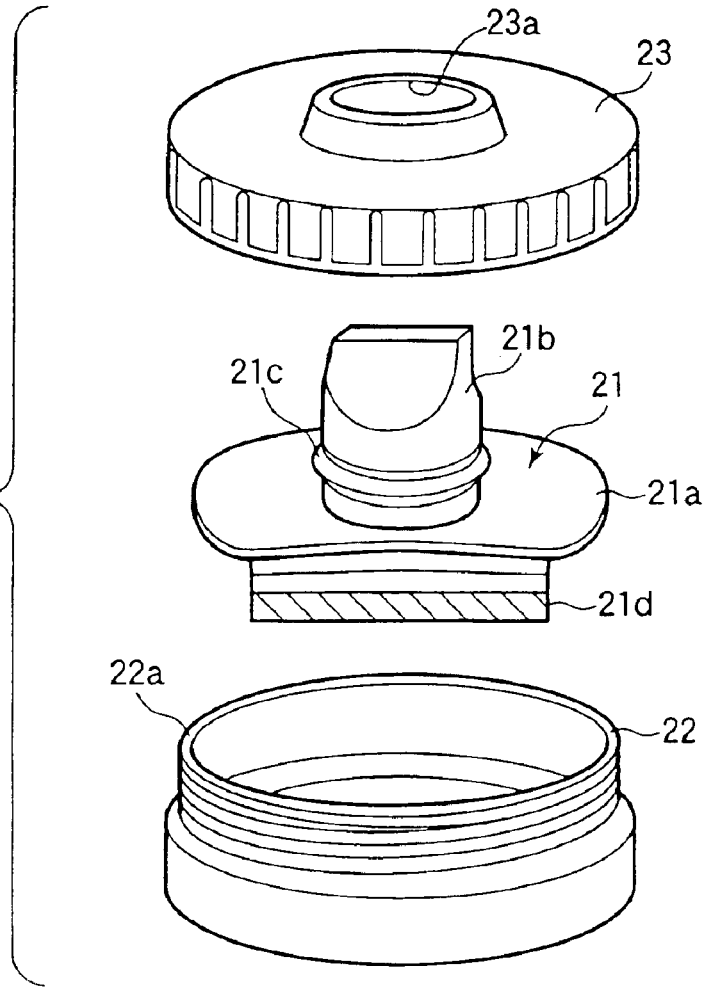
FIGS. 5A and 5B are schematic views of the second embodiment of the storage container according to the invention.
Figure 5B:
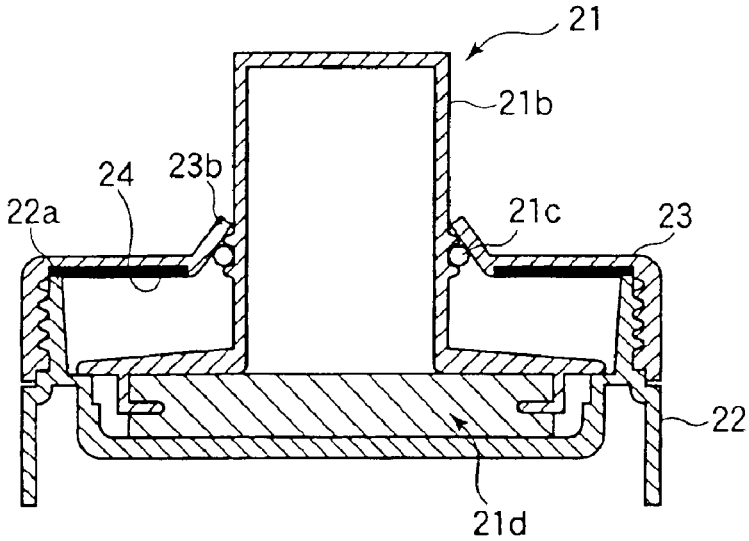

FIGS. 5A and 5B are schematic views of the second embodiment of the storage container according to the invention. FIG. 5A is an exploded perspective view, showing the components thereof, and FIG. 5B is a cross sectional view of the assembled container.

The coating tool 21 of this embodiment differs from the coating tool 11 of the first embodiment in that the rib 11*c* arranged at the coating tool 11 of the first embodiment (see FIGS. 1A and 1B) is replaced by a packing 21*c* that is a sealing member surrounding the handle 21*b* of the coating tool 21 in this embodiment. The packing 21*c* is made of an elastic material such as rubber. The handle 21*b* is provided with an upper and lower ridges that confine the packing 21*c* and prevent it from being displaced from the right position. The closure member 23 is provided along the opening 23*a* with an upwardly tapered seal rib 23*b*. The handle 21*b* has a part located closer to the front end relative to the part provided with the packing 21*c* that is provided with two substantially parallel planar areas.

Otherwise, the components of this embodiment including the coating tool 21, the holding container 22, the closure member 23 and the packing sheet 24 are similar to those of the first embodiment and hence will not be described here any further.

As shown in FIG. 5B, when the coating tool 21 is contained in the holding container 22 and the closure member 23 is screw-fitted to the holding container 22 so that the coating tool 21 is snugly stored in the storage container, the handle 21*b* of the coating tool 21 projects to the outside of the storage container through the opening 23*a* of the closure member 23. Therefore, no coating liquid in the storage container will adhere to the handle 21*b* when the coating tool 11 is in storage so that the efficiency of coating operation is prevented from decreasing.

Additionally, when the closure member 23 is fitted to the holding container 22 to close the latter in this condition, the rib 22*a* of the holding container 22 abuts on the packing sheet 24 on the inner surface of the closure 23 as shown in FIG. 5B. Therefore, no coating liquid will leak out from the inside of the storage container through the gap between the holding container 22 and the closure member 23. Furthermore, when the closure member 23 is fitted to the holding container 22 to close the latter, the packing 21*c* arranged on the handle 21*b* abuts on the inner surface of the rib 23*b* of the closure member 23 along all the lateral side of the closure member 23 to close the gap separating the peripheral edge of the closure member 23 defining the opening 23*a* and the handle 21*b*. As a result, no coating liquid will leak out through the gap separating the peripheral edge of the closure member 23 defining the opening 23*a* and the handle 21*b*. Additionally, the planar areas arranged near the front end of the handle 21*b* make it easier for the user to hold the handle 21*b*.

In this way, as in the case of the first embodiment, no coating liquid in the storage container will stick to the handle 21*b* when the coating tool 21 of this embodiment is in storage. Similarly, no coating liquid in the storage container will leak out from the inside when the container is held in storage.

Third Embodiment

Figure 6A:
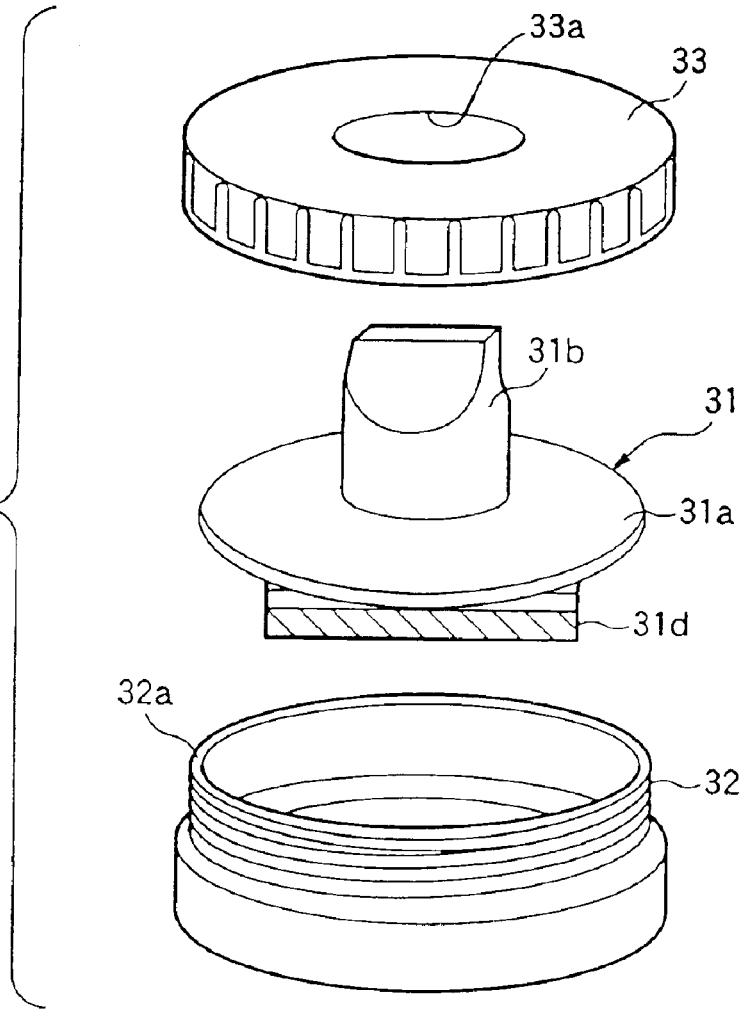
FIGS. 6A and 6B are schematic views of the third embodiment of the storage container according to the invention.
Figure 6B:
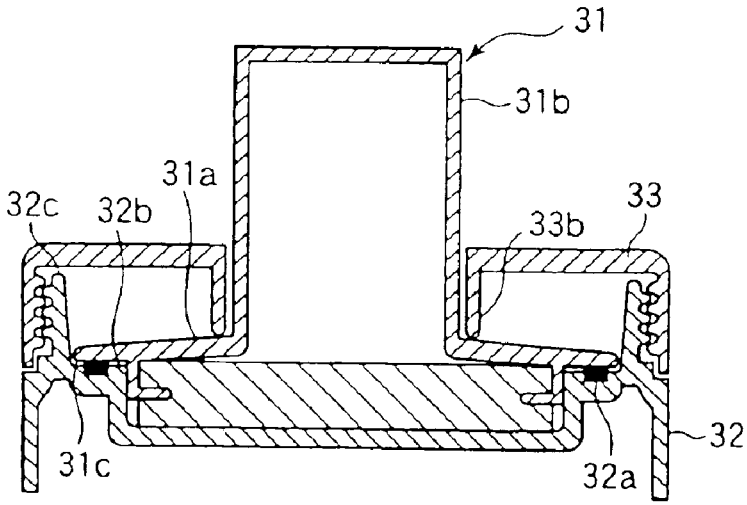

FIGS. 6A and 6B are schematic views of the third embodiment of the storage container according to the invention. FIG. 6A is an exploded perspective view, showing the components thereof, and FIG. 6B is a cross sectional view of the assembled container.

The coating tool 31 of this embodiment comprises a support member 31*a* that has a substantially cylindrical profile and is so dimensioned as to be contained in the holding container 32. While the absorbing member 31*d* may have a rectangularly parallelepipedic profile as in the case of the preceding embodiments, it preferably has a cylindrical shape that is as large as the absorbing member 31*d* so that the coated area may be visually observed. Note that the coating tool 31 of this embodiment is provided neither with a rib like the rib 11*c* of the first embodiment (see FIGS. 1A and 1B) nor with a packing like the packing 21*c* of the second embodiment (see FIG. 5).

On the other hand, a packing 32*a* is arranged on the stepped section 32*b* of the inner surface of the holding container 32 of this embodiment. The packing 32*a* is made of an elastic material and extends along all the lateral side so as to operate as a seal member for the abutting section. The packing 32*a* is arranged in such a way that, when the coating tool 31 is contained in the holding container 32, the stopper 31*c* that is arranged along the entire outer peripheral edge of the support member 31*a* abuts on it.

When the coating tool 31 is contained in the holding container 32 and a closure member 33 is screw-fitted to the holding container 32, a rib 33*b* extending toward the inside of the closure member 33 from an opening 33*a* of the closure member 33 pushes the upper surface of the support member 31*a* to the holding container 32. In this case a rib 32*c* of the holding container 32 does not abut on the inner surface of the closure member 33. With this arrangement, sealing is achieved between a stopper 31*c* of the support member 31*a* and the packing 32*a*, so that the coating liquid remaining in the bottom of the holding container 32 does not leak out to the outside of the sealing portion.

The preceding embodiments involve a risk that, when the storage container is tumbled during storage, the coating liquid remaining in the bottom of the holding container can stick to the upper surface of the support member. However, the coating liquid in the holding container will never rise above the stopper 31*c* of the support member 31*a* so that no liquid will stick to the upper surface of the support member 31*a* if the storage container is tumbled by mistake. Therefore, the risk that coating liquid sticks to the user's hand when he or she is using the coating tool 31 is minimized and, as a result, the efficiency of coating operation is prevented from decreasing.

Note that, while said packing 32*a* is arranged at the side of the holding container 32 in the above description, the present invention is by no means limited thereto and the packing may alternatively be arranged on the stopper 31*c* of the coating tool 31.

Fourth Embodiment

Figure 7A:
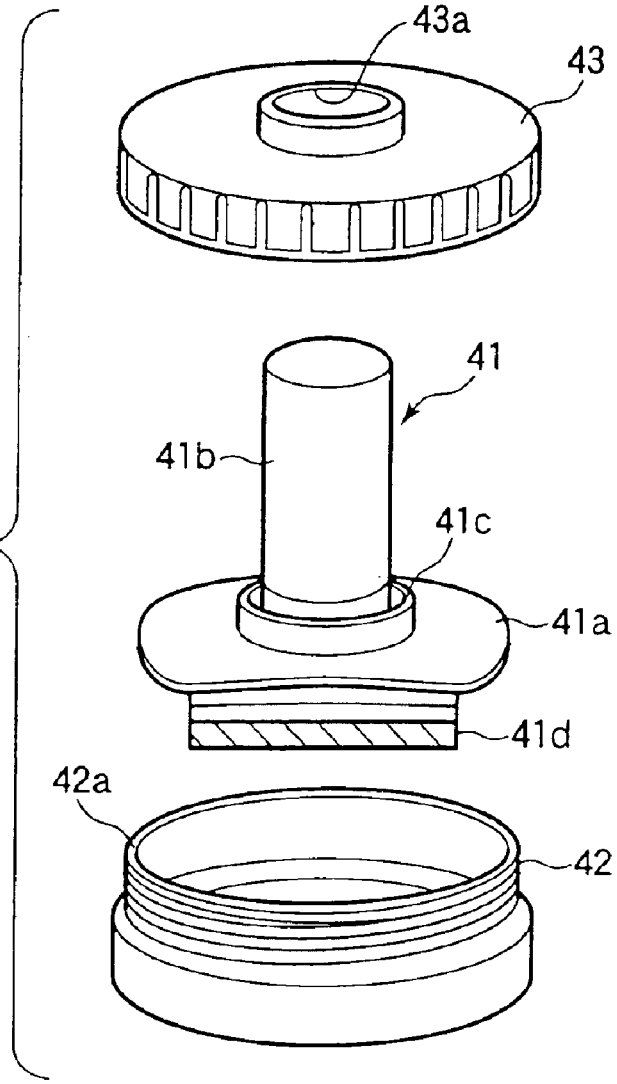
FIGS. 7A and 7B are schematic views of the fourth embodiment of the storage container according to the invention.
Figure 7B:
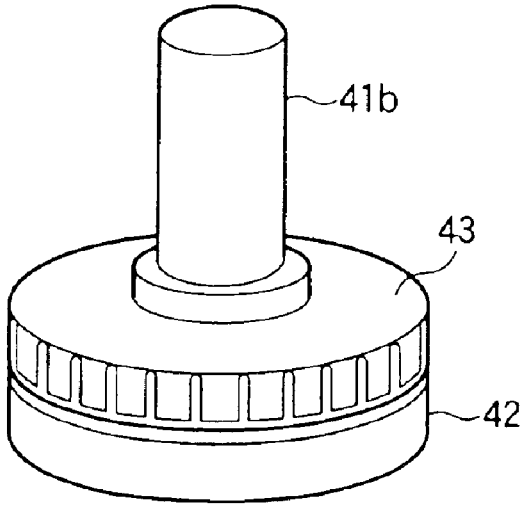
Figure 8:
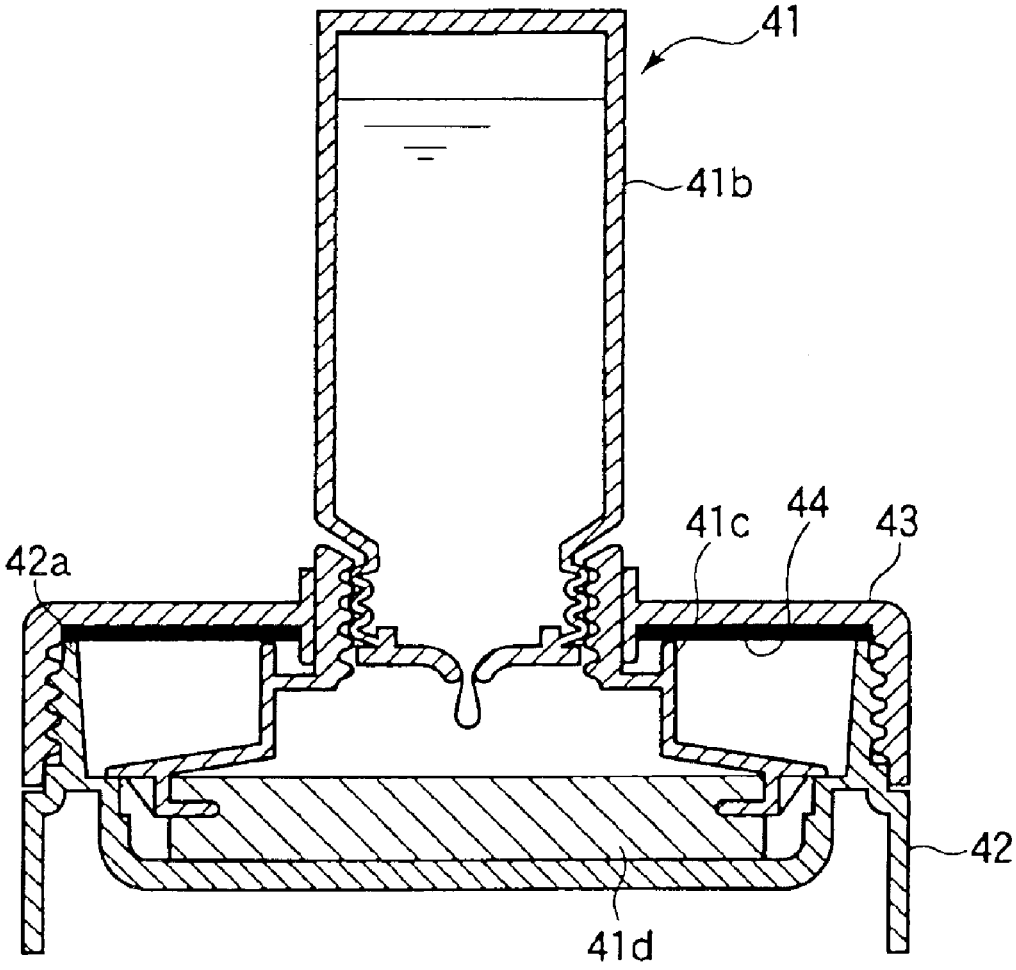
FIG. 8 is a schematic cross sectional view of the fourth embodiment of the storage container according to the invention.

FIGS. 7A, 7B and 8 are schematic views of the fourth embodiment of the storage container according to the invention. FIG. 7A is an exploded perspective view, showing the components thereof, FIG. 7B is a perspective view of the assembled container and FIG. 8 is a cross sectional view of the assembled container.

This embodiment differs from the first embodiment in that the handle 11*b* of the coating tool 11 of the first embodiment (see FIGS. 1A and 1B) is replaced by a handle 41*b* that operates as a bottle for containing the coating liquid in the inside and is fitted to the support member 41*a* for the coating tool 41 of this embodiment. As shown in FIG. 8, the handle

41*b* is threaded so as to operate as a male screw, while the support member 41*a* is also threaded so as to operate as a female screw. Thus, the handle 41*b* is fitted to the support member 41*a* as the male screw of the handle 41*b* is driven into the female screw of the support member 41*a*.

Otherwise, the components of this embodiment including the coating tool 41, the holding container 42, the closure member 43 and the packing sheet 44 are similar to those of the first embodiment and hence will not be described here any further.

The coating liquid in the handle 41*b* can be made to drop onto the upper surface of the absorbing member 41*d* through an outlet at the lower end of the handle 41*b* typically by forcibly grasping the lateral wall of handle 41*b* with hand. The coating liquid dropped onto the upper surface of the absorbing member 41*d* filtrates into the absorbing member 41*d* so that it can be applied to the object of coating by using the lower surface of the absorbing member 41*d*. As described above, the coating tool 41 of this embodiment does not require the operation of pouring a coating liquid into the holding container 42 and causing the absorbing member 41*d* to absorb it so that the efficiency of the operation of applying coating liquid can be further improved.

It should be noted that, when the closure member 43 is tightly fitted to the holding container 42 with the coating tool 41 contained in the holding container 42, the handle 42*b* projects outward through the opening 43*a* of the closure member 43 and the two ribs 41*c*, 42*a* abut on the packing sheet 44 on the inner surface of the closure member 43 as in the case of the first embodiment. Therefore, no coating liquid will leak out from the inside of the storage container through the gap between the holding container 42 and the closure member 43 and/or through the opening 43*a* of the closure member 43. The present invention is by no means limited to the above described embodiments, which may be combined in various different ways to achieve the advantages of the present invention.

Advantages of the Invention

As described above in detail, the closure member of a storage container according to the invention is provided with an opening for allowing the handle of the coating tool to pass through so that the handle of the coating tool projects outward through the opening when the holding container is closed by means of the closure member with the coating tool stored in the holding container. Therefore, no coating liquid will stick to the hand when the storage container is held in storage so that the efficiency of coating operation is prevented from decreasing.

What is claimed is:

1. A storage container comprising a holding container adapted to hold a coating tool for applying a liquid and a closure member adapted to close the holding container holding the coating tool, the coating tool being provided with a handle section to be used for gripping the coating tool, the closure member being provided with an opening through which the handle section passes, the storage container having such a structure that the handle section projects outward through the opening when closing the holding container by means of the closure member with the coating tool held in the holding container, the storage container in the condition that the closure member is in a closed position comprising a first contact portion and a second contact portion which form a sealed condition by contact between the coating tool and the closure member, and a third contact portion and a fourth contact portion which form a sealed condition by contact between the holding container and the closure member, wherein the coating tool is provided with an abutting section and the inner surface of the holding container is provided with a stepped section on which the abutting section of the coating tool abuts when the coating tool is contained in the holding container, and wherein the coating tool is provided at the bottom thereof with an absorbing member adapted to hold the liquid, and the height of the stepped section from the bottom of the holding container is such that the absorbing member comes into contact with the bottom of the holding container without being deformed when the abutting section of the coating tool abuts on the stepped section of the holding container.

2. The storage container according to claim 1, wherein the first contact portion of the coating tool is provided with a rib adapted to abut on the inner surface of the closure member along the entire boundary of the opening when the holding container is closed by the closure member with the coating tool held in the holding container, and the third contact portion of the holding container is provided with a rib adapted to abut on the entire outer edge and/or the vicinity thereof of the closure member when the holding container is closed by means of the closure member.

3. The storage container according to claim 2, wherein the rigidity of the closure member is lower than that of the rib of the coating tool and that of the rib of the holding container.

4. The storage container according to claim 2, wherein the second contact portion and the fourth contact portion of the closure member are comprised by a seal member adapted to abut on both the rib of the coating tool and the rib of the holding container when the closure member is fitted to the holding container to close it.

5. The storage container according to claim 1, wherein the first contact portion of the coating tool is a rib provided along lateral surfaces of the handle section and surrounding the handle section to seal the closure member at the opening, and the second contact portion provided at the opening of the closure member is a sealing member adapted to abut on the rib along the entire periphery thereof when the holding container containing the coating tool is closed by the closure member.

6. The storage container according to claim 1, wherein the coating tool is provided with a rib for supporting the abutting section.

7. A storage container comprising a holding container adapted to hold a coating tool for applying a liquid and a closure member adapted to close the holding container holding the coating tool, the coating tool being provided with a handle section to be used for gripping the coating tool, the closure member being provided with an opening through which the handle section passes, the storage container having such a structure that the handle section projects outward through the opening when closing the holding container by means of the closure member with the coating tool held in the holding container, the storage container in the condition that the closure member is in a closed position comprising a first contact portion and a second contact portion which form a sealed condition by contact between the coating tool and the closure member, and a third contact portion and a fourth contact portion which form a sealed condition by contact between the holding container and the closure member, wherein the coating tool is provided with an abutting section, and the inner surface of the holding container is provided with a stepped section on which the abutting section of the coating tool abuts when the coating tool is contained in the holding container, and wherein the coating tool is provided at the bottom thereof with an absorbing member adapted to hold the liquid, and the height of the stepped section from the bottom of the holding container is such that the absorbing member being elastically deformed comes into contact with the bottom of the holding container when the abutting section of the coating tool abuts on the stepped section of the holding container.

8. The storage container according to claim 7, wherein the first contact portion of the coating tool is provided with a rib adapted to abut on the inner surface of the closure member along the entire boundary of the opening when the holding container is closed by the closure member with the coating tool held in the holding container, and the third contact portion of the holding container is provided with a rib adapted to abut on the entire outer edge and/or the vicinity thereof of the closure member when the holding container is closed by means of the closure member.

9. The storage container according to claim 8, wherein the rigidity of the closure member is lower than that of the rib of the coating tool and that of the rib of the holding container.

10. The storage container according to claim 8, wherein the second contact portion and the fourth contact portion of the closure member are comprised by a seal member adapted to abut on both the rib of the coating tool and the rib of the holding container when the closure member is fitted to the holding container to close it.

11. The storage container according to claim 7, wherein the first contact portion of the coating tool is a rib provided along lateral surfaces of the handle section and surrounding the handle section to seal the closure member at the opening, and the second contact portion provided at the opening of the closure member is a sealing member adapted to abut on the rib along the entire periphery thereof when the holding container containing the coating tool is closed by the closure member.

12. The storage container according to claim 7, wherein the coating tool is provided with a rib for supporting the abutting section.

* * * * *